US007122966B2

(12) United States Patent
Norling et al.

(10) Patent No.: US 7,122,966 B2
(45) Date of Patent: Oct. 17, 2006

(54) ION SOURCE APPARATUS AND METHOD

(75) Inventors: Jonas Ove Norling, Uppsala (SE); Jan-Olof Bergström, Uppsala (SE)

(73) Assignee: General Electric Company, Schenectady, NY (US)

( * ) Notice: Subject to any disclaimer, the term of this patent is extended or adjusted under 35 U.S.C. 154(b) by 8 days.

(21) Appl. No.: 11/012,125

(22) Filed: Dec. 16, 2004

(65) Prior Publication Data

US 2006/0132068 A1 Jun. 22, 2006

(51) Int. Cl.
*H01J 7/24* (2006.01)

(52) U.S. Cl. ..... 315/111.81; 250/423 R; 250/492.21; 313/363.1; 313/231.31

(58) Field of Classification Search ..... 315/111.21–111.41, 111.71–111.91; 250/423 R, 250/427, 492.21; 313/231.31, 230, 62, 362.1, 313/363.1

See application file for complete search history.

(56) References Cited

U.S. PATENT DOCUMENTS 4,506,160 A 3/1985 Sugawara et al.
4,658,143 A 4/1987 Tokiguchi et al.
4,970,435 A * 11/1990 Tanaka et al. ..... 315/111.21
5,028,791 A 7/1991 Koshiishi et al.
5,523,652 A * 6/1996 Sferlazzo et al. ..... 315/111.41
5,898,178 A 4/1999 Bunker
6,140,773 A * 10/2000 Anders et al. ..... 315/111.21
6,294,862 B1 9/2001 Brailove et al.
6,664,547 B1 12/2003 Benveniste
6,734,434 B1 5/2004 Sainty
6,756,600 B1 6/2004 Ng et al.
6,844,556 B1 1/2005 Kinoyama
6,943,347 B1 * 9/2005 Willoughby et al. ..... 250/288
2002/0053880 A1 5/2002 Miyamoto
2003/0218429 A1 11/2003 Kinoyama
2005/0283199 A1 * 12/2005 Norling et al. ..... 607/33

* cited by examiner

*Primary Examiner*—Haissa Philogene
(74) *Attorney, Agent, or Firm*—Hunton & Williams LLP

(57) ABSTRACT

The invention relates to a method and apparatus that can improve the lifetime and performance of an ion source in a cyclotron. According to one embodiment, the invention comprises an ion source tube for sustaining a plasma discharge therein. The ion source tube comprises a slit opening along a side of the ion source tube, wherein the slit opening has a width less than 0.29 mm. The ion source tube also comprises an end opening in an end of the ion source tube. The end opening is smaller than an inner diameter of the ion source tube and is displaced by 0–1.5 mm from a central axis of the ion source tube toward the slit opening. The plasma column is displaced 0.2 to 0.5 mm relative the slit opening. The ion source tube comprises a cavity that accommodates the plasma discharge. The invention also relates to a method for making an ion source tube.

37 Claims, 6 Drawing Sheets

ION SOURCE APPARATUS AND METHOD

BACKGROUND OF THE INVENTION

The present invention relates generally to the field of cyclotron design for radiopharmacy and more particularly to a method and apparatus that can improve ion source lifetime and performance.

Hospitals and other health care providers rely extensively on positron emission tomography (PET) for diagnostic purposes. PET scanners can produce images which illustrate various biological process and functions. In a PET scan, the patient is initially injected with a radioactive substance known as a PET isotope (or radiopharmaceutical). The PET isotope may be $^{18}$F-fluoro-2-deoxyglucose (FDG), for example, a type of sugar which includes radioactive fluorine. The PET isotope becomes involved in certain bodily processes and functions, and its radioactive nature enables the PET scanner to produce an image which illuminates those functions and processes. For example, when FDG is injected, it may be metabolized by cancer cells, allowing the PET scanner to create an image illuminating the cancerous region.

PET isotopes are mainly produced with cyclotrons, a type of particle accelerators. A cyclotron usually operates at high vacuum (e.g., $10^{-7}$ Torr). In operation, charged particles (i.e., ions) are initially extracted from an ion source. Then, the ions are accelerated while being confined by a magnetic field to a circular path. A radio frequency (RF) high voltage source rapidly alternates the polarity of an electrical field inside the cyclotron chamber, causing the ions to follow a spiral course as they acquire more kinetic energy. Once the ions have gained their final energy, they are directed to a target material to transform it into one or more desired PET isotopes. Since a cyclotron typically involves a substantial investment, its isotope-producing capacity is very important. Theoretically, the production rate of isotopes in a given target material is directly proportional to the flux of the charged particles (i.e., ion beam current) that bombard the target. Therefore, it would be desirable to extract a high output of ion current from the ion source.

Apart from the ion output, the lifetime of an ion source is also important. An ion source typically has a limited lifetime and therefore requires periodic replacement. During a scheduled service, the cyclotron needs to be opened up to allow access to the ion source. However, since the cyclotron usually becomes radioactive during isotope production, it is necessary to wait for the radiation to decay to a safe level before starting the service. In one cyclotron, for example, the wait for the radiation decay can last ten hours. Replacement of the ion source takes some time depending on the complexity of the ion source assembly as well as its accessibility. After the ion source has been replaced, it takes additional time for a high vacuum to be restored inside the cyclotron. As a result, every scheduled service for ion source replacement causes extended down time in isotope production. Therefore, it would be desirable to improve the lifetime of the ion source so that the isotope production time will be longer between scheduled services.

FIG. 1 illustrates the operation of a known plasma-based ion source 100 used in cyclotrons for isotope production. As shown, the ion source 100 comprises an ion source tube 104 positioned between two cathodes 102. The ion source tube 104 may be grounded while the two cathodes 102 may be biased at a high negative potential with a power source 112. The ion source tube 104 may have a cavity 108 into which one or more gas ingredients may be flowed. For example, a hydrogen ($H_2$) gas flow of around 10 sccm may be flowed into the cavity 108. The voltage difference between the cathodes 102 and the ion source tube 104 may cause a plasma discharge (110) in the hydrogen gas, creating positive hydrogen ions (protons) and negative hydrogen ions ($H^-$). These hydrogen ions may be confined by a magnetic field 120 imposed along the length of the ion source tube 104. A puller 116, biased with a power source 114 at an alternating potential, may then extract the negative hydrogen ions through a slit opening 106 on the ion source tube 104 during positive half periods of the alternating potential. The extracted negative hydrogen ions 118 may be further accelerated in the cyclotron (not shown) before being used in isotope production.

FIGS. 2–7 illustrate a prior art design of an ion source tube 200, where FIG. 2 is a perspective view of the ion source tube 200, FIG. 3 is a front view, FIG. 4 is a side view, FIGS. 5 and 7 are cross-sectional views of the section a—a, and FIG. 6 is a cross-sectional view of the section b—b. The length unit is millimeters (mm). The ion source tube 200 has a cylindrical cavity 212 that is centered along the axis 216. There is also a slit opening 214 along the front side of the ion source tube 200. This prior art design further requires two separate restrictor rings 210 that can be inserted into the cavity 212 and positioned against the edges 220 and 222 to help define the shape and position of the plasma column 218.

Some drawbacks may exist in the design of the prior art ion source tube 200. For example, the use of the restrictor rings 210 may require some amount of time for assembly and adjustment during manufacturing. And the prior art design of the restrictor rings may impose a stringent manufacturing tolerance. Furthermore, the slit opening 214 can degrade relatively quickly due to bombardment of the ions generated in the plasma column 216, leading to a short lifetime of the ion source tube 200.

These and other drawbacks may exist in known systems and methods.

BRIEF SUMMARY OF THE INVENTION

The present invention is directed to method and apparatus for improving ion source lifetime and performance that overcomes these and other drawbacks of known systems and methods.

According to one embodiment, the invention relates to an ion source tube for sustaining a plasma discharge therein, the ion source tube comprising: a slit opening along a side of the ion source tube, wherein the slit opening has a width less than 0.29 mm; an end opening in at least one end of the ion source tube, wherein the end opening is smaller than an inner diameter of the ion source tube and is displaced by 0–1.5 mm from a central axis of the ion source tube toward the slit opening; and a cavity that accommodates the plasma discharge.

According to another embodiment, the invention relates to a method for making an ion source tube, the method comprising: forming an ion source tube, the ion source tube comprising a slit opening along a side of the ion source tube, wherein the slit opening has a width of less than 0.29 mm; an end opening in at least one end of the ion source tube, wherein the end opening is smaller than an inner diameter of the ion source tube and is displaced by 0–1.5 mm from a central axis of the ion source tube toward the slit opening; and a cavity in which the plasma discharge is located.

BRIEF DESCRIPTION OF THE DRAWINGS

In order to facilitate a fuller understanding of the present invention, reference is now made to the appended drawings. These drawings should not be construed as limiting the present invention, but are intended to be exemplary only.

DETAILED DESCRIPTION OF THE INVENTION

Reference will now be made in detail to exemplary embodiments of the invention.

Figure 1:
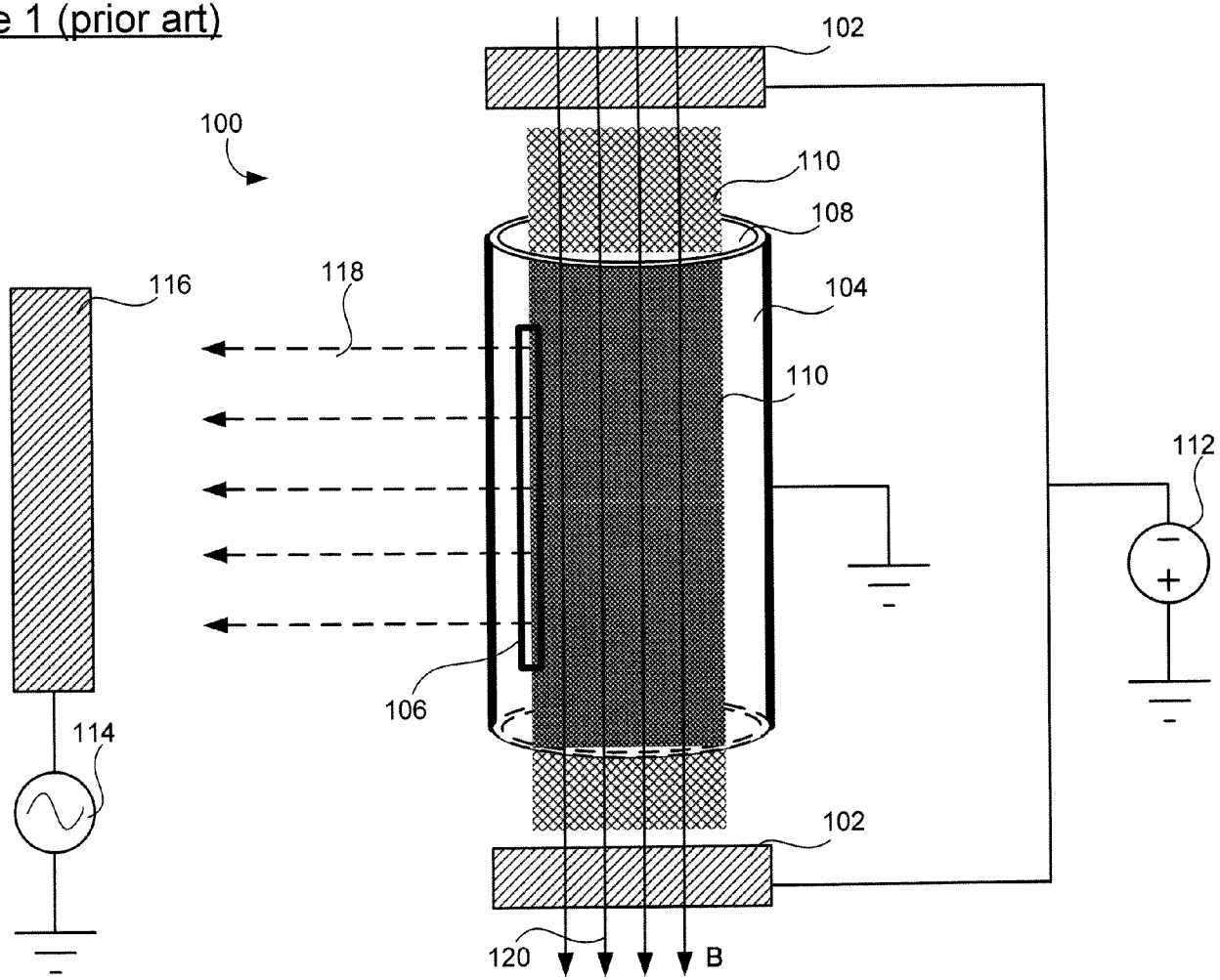
Figure 1 (prior art)
FIG. 1 illustrates the operation of a known plasma-based ion source used in cyclotrons for isotope production.
Figure 2:
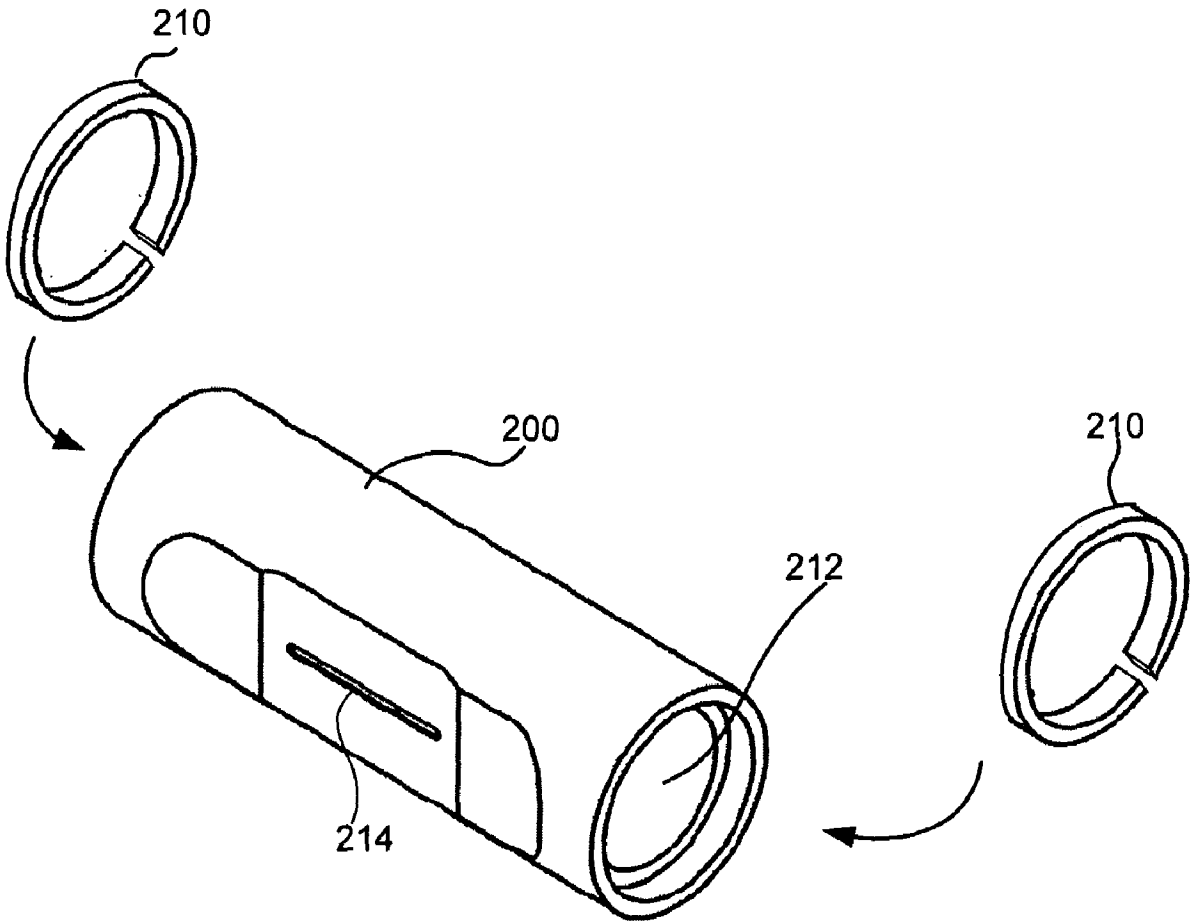
Figure 2 (prior art)
FIGS. 2–7 illustrate a prior art design of an ion source tube.
Figure 7:
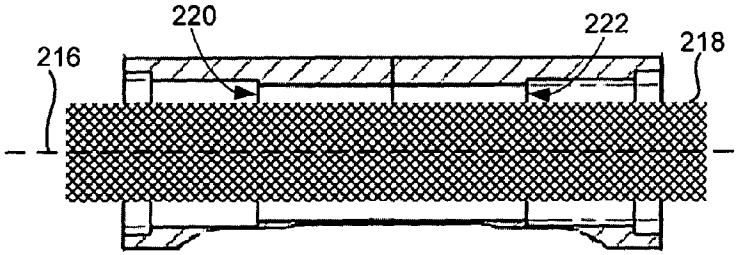
Figure 7 (prior art)
Figure 4:
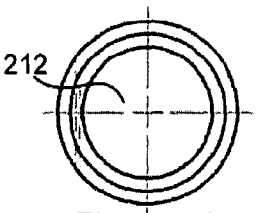
Figure 4 (prior art)
Figure 6:
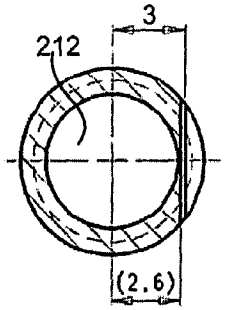
Figure 6 (prior art)
Figure 3:
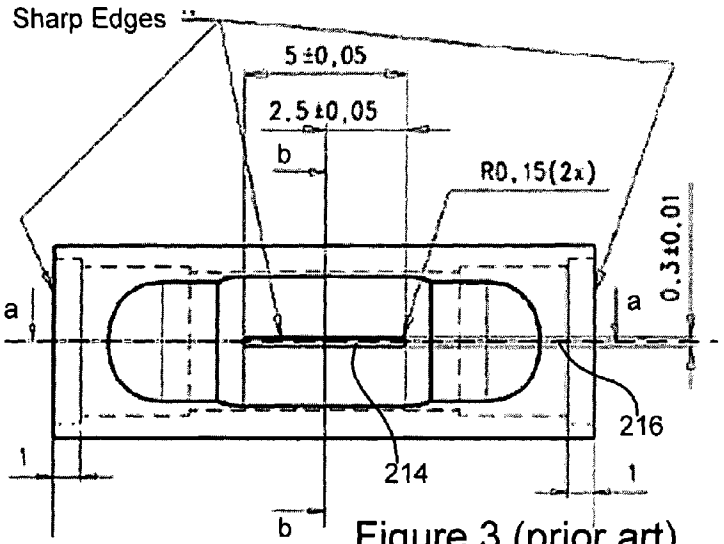
Figure 3 (prior art)
Figure 5:
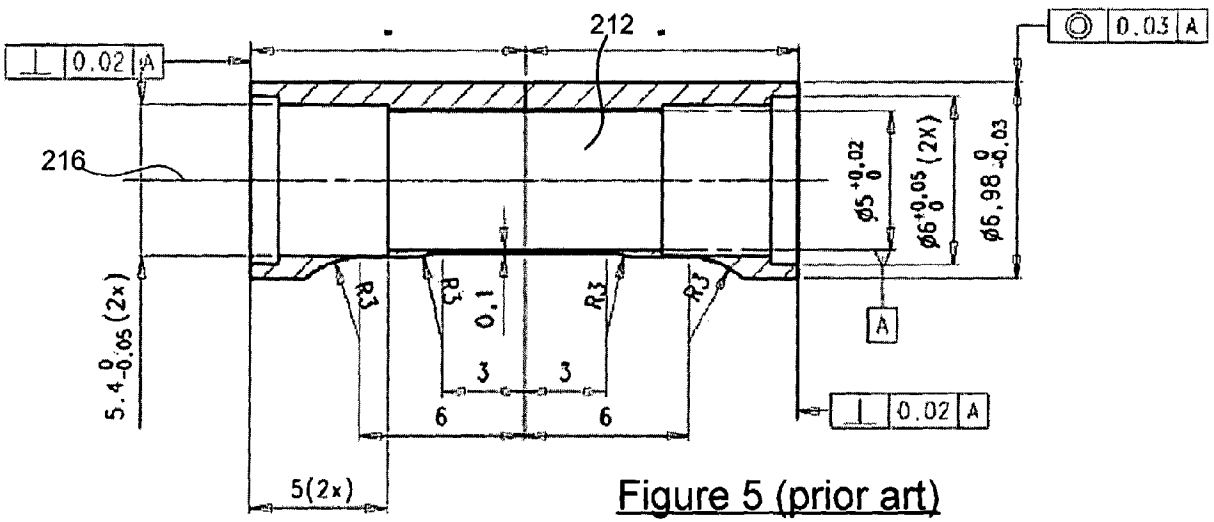
Figure 5 (prior art)
Figure 8:
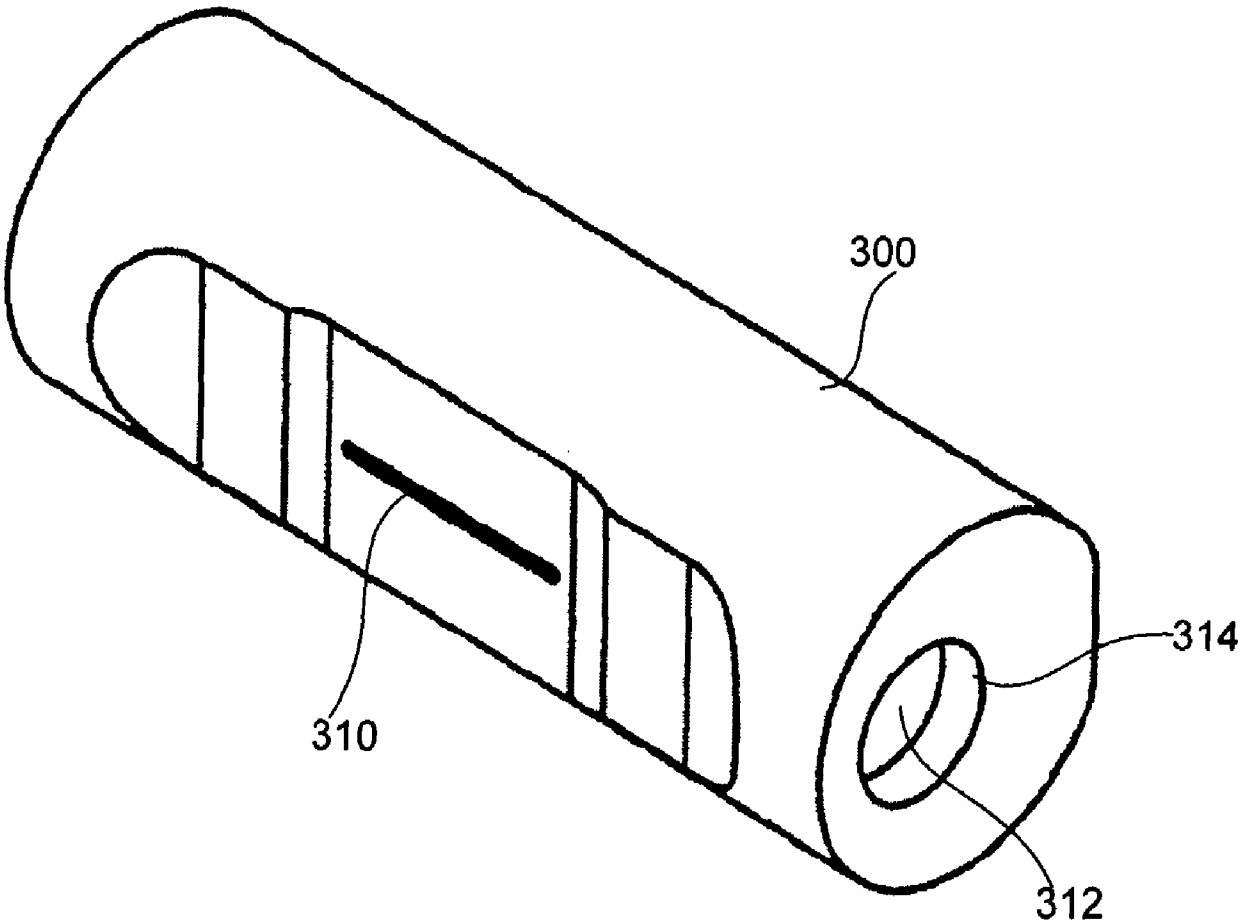
FIG. 8 is a perspective view of an exemplary ion source tube according to an embodiment of the invention.

Referring to FIG. 8, there is shown a perspective view of an exemplary ion source tube 300 according to an embodiment of the invention. The ion source tube 300 may be used in a plasma-based ion source similar to the one shown in FIG. 1. A plasma discharge (not shown) may be sustained in or near the ion source tube 300. The ion source tube 300 may be made of metals (e.g., copper and tungsten) that are resistant to heat and the plasma discharge. As shown, the exemplary ion source tube 300 has a substantially cylindrical shape. There may be a slit opening 310 in the front side of the ion source tube 300 for extraction of ions. There may be an end opening 314 in the end of the ion source tube 300 to accommodate a flow of gas ingredient(s) and to help define the shape and position of the plasma discharge. Inside the ion source tube 300, there may be a pre-shaped cavity 312 that further defines the shape and position of the plasma discharge as well as its density. Details of the interior geometry of the ion source tube 300 are described in connection with FIGS. 9–12.

It should be noted that the ion source tube 300 is typically manufactured in one piece. That is, the geometrical parameters that affect the ion beam currents, such as the width of the slit opening 310 and the shape of the cavity 312, may be predetermined based on, for example, experiments or theoretical calculations (e.g., computer simulation). Then, the desired set of parameters may be incorporated into the ion source tube 300 to form one integral structure that requires little or no assembly or adjustment. This design methodology can reduce the need for time-consuming adjustment of the ion source tube 300 and can increase the machining tolerances.

Figure 9:
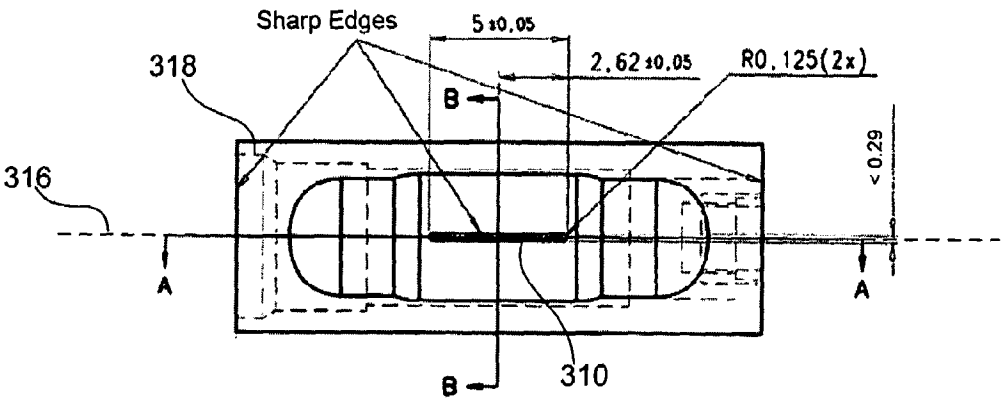
FIGS. 9–12 are mechanical diagrams illustrating the exemplary ion source tube shown in FIG. 8.
Figure 11:
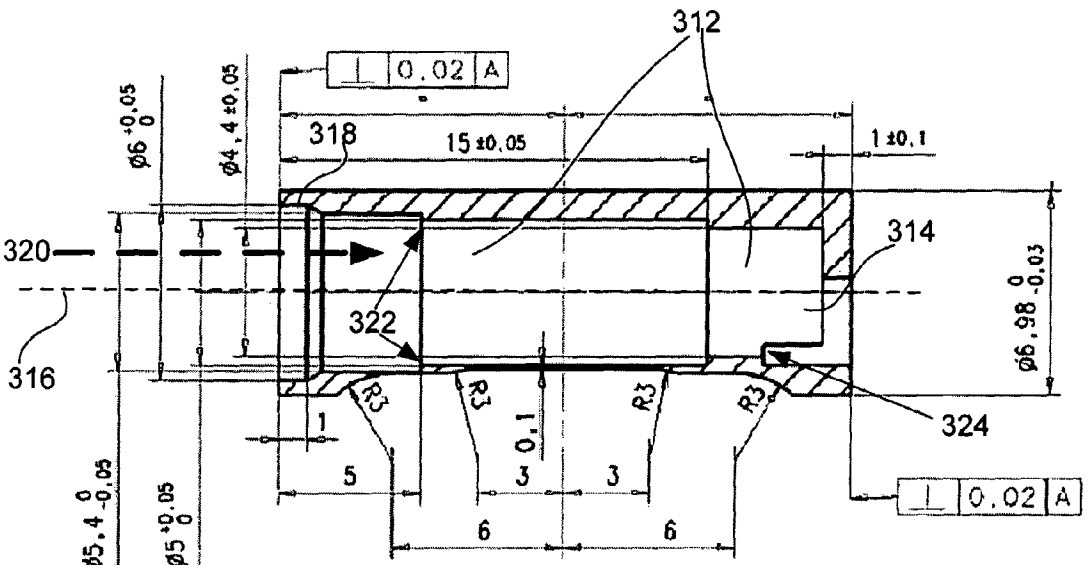
Figure 10:
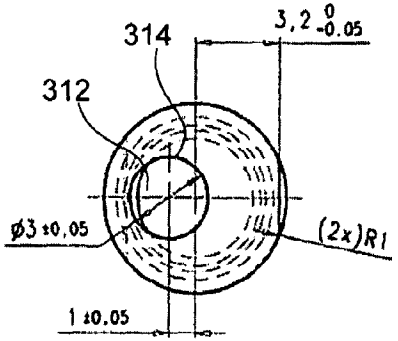
Figure 12:
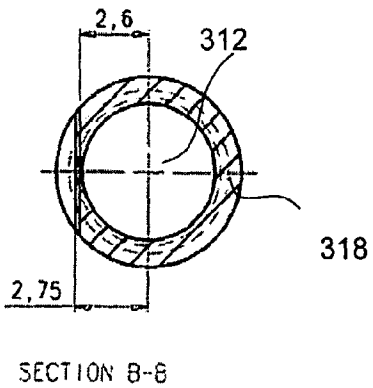

FIGS. 9–12 are mechanical diagrams illustrating the exemplary ion source tube shown in FIG. 8. FIG. 9 is a front view of the ion source tube 300, FIG. 10 is a side view, FIG. 11 is a cross-sectional view of the section A—A, and FIG. 12 is a cross-sectional view of the section B—B. The length unit is millimeters (mm).

The overall length of the ion source tube 300 shown in FIG. 9 may be 20 mm, with a tolerance of 0.05 mm, for example. Of course, these values, and the other values set forth herein, are merely examples. The slit opening 310 along the front side of the ion source tube 300 may have a width of less than 0.3 mm, more preferably less than 0.29 mm and greater than 0.1 mm, still more preferably less than 0.25 mm and greater than 0.15 mm, and most preferably a width of 0.2 mm with a tolerance of 0.01 mm. The length of the slit opening 310 may be 4–6 mm, more preferably 5.00 mm with a tolerance of 0.05 mm. The slit opening 310 and both ends of the ion source tube 300 may have sharp edges.

FIG. 10 shows a view of the ion source tube 300 seen from one end. The end opening 314 typically has a diameter of 2.5–5 mm, and preferably has a diameter of 3.00 mm with a tolerance of 0.05 mm. Also as shown in FIGS. 10 and 11, the end opening 314 is typically but not necessarily off center from a central axis 316 of the ion source tube. For example, the end opening 314 may be zero or greater than zero up to 1.5 mm off center from the central axis 316, and is preferably about 1.00 mm off center from the central axis 316. As a result, a plasma column (not shown) restricted by the end opening 314 may be moved off-center and closer to the slit opening 310. A position of the plasma column close to the slit opening 310 typically improves the efficiency of ion extraction. Furthermore, the diameter of the end opening 314 may be smaller than that of the cavity 312 inside the ion source tube 300, which may help increase the density of the plasma discharge to create more ions. Typically, the diameter of the plasma discharge inside the ion source tube is about 2.5–5 mm, more preferably 3 mm.

FIG. 12 shows that the distance between the slit opening 310 and the central axis 316 can be about 2.6 mm, according to one example. Assuming that a plasma column restricted by the end opening 314 and a built-in restrictor 324 maintains a straight cylindrical shape throughout the length of the ion source tube 300, the edge of the plasma column may be only 0.3 mm away from the slit opening 310. Typically, the edge of the plasma column is 0.2–0.5 mm away from the slit opening 310. The thickness of the ion source tube at the edge of the slit opening 310 is typically 0.05–0.15 mm, and preferably 0.1 mm as shown in FIG. 11. The thickness of the ion source tube at the edge of the slit opening 310 may have two effects on performance. For example, a thinner edge may lead to an improved electric field penetration and hence a better $H^-$ output. A thinner edge, however, may cause a shorter lifetime of the ion source tube as it will be less resistant to wear. The chosen edge thickness may be a trade-off between the two effects.

Figure 14:
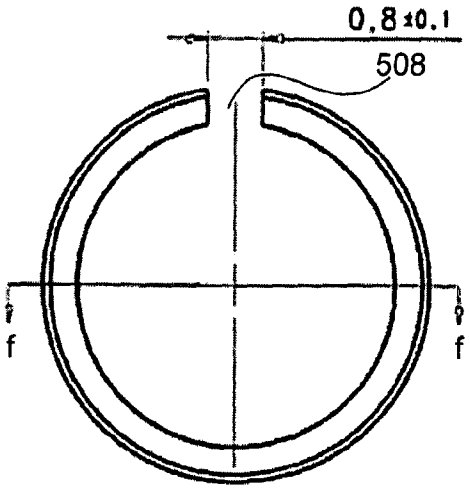
FIGS. 13–16 are mechanical diagrams illustrating an exemplary restrictor ring according to an embodiment of the invention.
Figure 15:
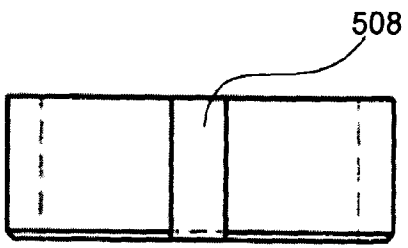
Figure 16:
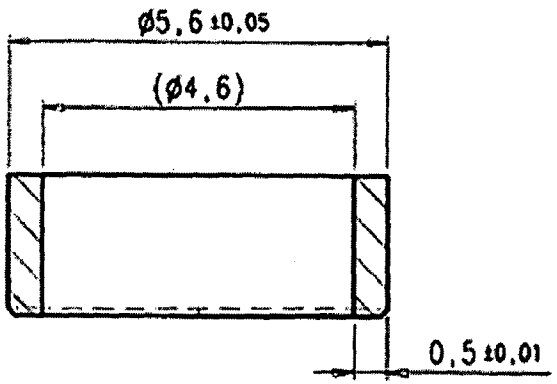
Figure 13:
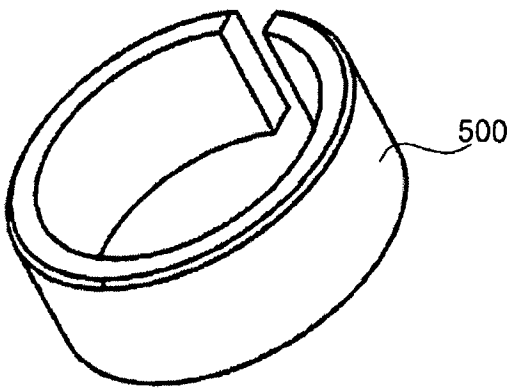

FIGS. 13–16 are mechanical diagrams illustrating an exemplary restrictor ring according to an embodiment of the invention. FIG. 13 is a perspective view of the restrictor ring 500, FIG. 14 is a top view, FIG. 15 is a side view, and FIG. 16 is a cross-sectional view of the section f—f. The length unit is millimeters (mm).

According to embodiments of the invention, one or more restrictor rings, such as the one shown in FIG. 13, may be inserted into an ion source tube to further alter the shape of its cavity. For example, the restrictor ring 500 may be inserted, along the dashed line 320 in FIG. 11, into the cavity 312. The restrictor ring 500 may be made of a heat- and plasma-resistant metal (e.g., tungsten or copper). As shown in FIG. 16, the restrictor ring 500 may have an inner diameter of 4.60 mm and an outer diameter of 5.60 mm. As shown in FIG. 14, the restrictor ring 500 may have a 0.8 mm wide slit 508. The slit 508 may allow slight bending of the restrictor ring 500 during insertion and adjustment. And the dimensions of the inner and outer diameters may allow the restrictor ring 500 to rest against the flange 322 shown in FIG. 11.

According to embodiments of the invention, although it may be desirable to manufacture an ion source tube in a single piece incorporating all the key parameters for ion extraction, sometimes it may be too difficult or too expensive to machine the tube to fit all the requirements. For example, referring again to FIG. 11, it may be difficult to make a one-piece ion source tube 300 whose cavity 312 is wider in the center portion and narrower on both ends. However, when the restrictor ring 500 is inserted along the dashed line 320 and rested against the flange 322, the desired symmetry in the shape of the cavity 312 may be achieved with respect to the section B—B.

In summary, embodiments of the present invention can offer a number of advantageous features to improving the lifetime and performance of an ion source. For example, a one-piece design may incorporate all the key parameters that may affect the output ion current, such as the width of the slit opening, the distance between the slit opening and the edge of the plasma column, and the shape of the plasma column. With almost no discrete parts, the one-piece ion source tube may be easy to install and adjust. The geometry of the cavity inside the ion source tube may be designed to achieve efficient ion generation and extraction. For example, an off-center end opening in one end of the cavity may position the plasma column closer to the slit opening. The shape of the plasma column may be configured based on geometrical parameters of the off-center opening and the cavity. The size of the off-center opening and the cavity may be reduced to increase the density of the plasma column, for example. With the optional restrictor ring(s), embodiments of the present invention also offer flexibility in design and manufacturing of the ion source tube. When the one-piece design is difficult to realize, one or more restrictor rings of appropriate shapes and dimensions may be inserted into the ion source tube to achieve a desired geometry.

While the foregoing description includes many details, it is to be understood that these have been included for purposes of explanation only, and are not to be interpreted as limitations of the present invention. It will be apparent to those skilled in the art that other modifications to the embodiments described above can be made without departing from the spirit and scope of the invention. Accordingly, such modifications are considered within the scope of the invention as intended to be encompassed by the following claims and their legal equivalents.

The invention claimed is:

1. An ion source tube for sustaining a plasma discharge therein, the ion source tube comprising:

a slit opening along a side of the ion source tube, wherein the slit opening has a width less than 0.29 mm;

an end opening in an end of the ion source tube, wherein the end opening is smaller than an inner diameter of the ion source tube and is displaced by 0–1.5 mm from a central axis of the ion source tube toward the slit opening; and a cavity that accommodates the plasma discharge.

2. The ion source tube of claim 1, wherein the end opening has a diameter of 2.5–5 mm.

3. The ion source tube of claim 1, wherein at least one of a built-in restrictor and the end opening causes an edge of the plasma discharge to be 0.2–0.5 mm away from the slit opening.

4. The ion source tube of claim 1, wherein the plasma discharge has a diameter of 2.5–5 mm.

5. The ion source tube of claim 1, wherein the slit opening has a width of greater than 0.1 mm.

6. The ion source tube of claim 1, wherein the slit opening has a width between 0.15 mm and 0.25 mm.

7. The ion source tube of claim 1, wherein the slit opening has a width of about 0.2 mm.

8. The ion source tube of claim 1, wherein the ion source tube has a one-piece construction.

9. The ion source tube of claim 8, further comprising a restrictor ring for insertion into the one-piece ion source tube to alter the geometry of the cavity.

10. The ion source tube of claim 1, wherein the ion source tube is biased as an anode for the plasma discharge.

11. The ion source tube of claim 1, wherein the ion source tube comprises one or more materials that are resistant to the plasma discharge.

12. The ion source tube of claim 1, wherein the ion source tube comprises copper and tungsten.

13. The ion source tube of claim 1, wherein the end opening is displaced by greater than zero millimeter from the central axis of the ion source tube toward the slit opening.

14. A method for making an ion source tube, the method comprising:

forming an ion source tube, the ion source tube comprising:

a slit opening along a side of the ion source tube, wherein the slit opening has a width of less than 0.29 mm;

an end opening in an end of the ion source tube, wherein the end opening is smaller than an inner diameter of the ion source tube and is displaced by 0–1.5 mm from a central axis of the ion source tube toward the slit opening; and a cavity in which the plasma discharge is located.

15. The method of claim 14, wherein the ion source tube is formed as one piece.

16. The method according to claim 15 further comprising inserting at least one restrictor ring into the one-piece ion source tube to alter the geometry of the cavity.

17. The method according to claim 15, further comprising biasing the one-piece ion source tube as an anode for the plasma discharge.

18. The method according to claim 14, further comprising forming the end opening to have a diameter of 2.5–5 mm.

19. The method according to claim 14, wherein at least one of a built-in restrictor and the end opening causes an edge of the plasma discharge to be 0.2–0.5 mm away from the slit opening.

20. The method according to claim 14, wherein the plasma discharge has a diameter of 2.5–5 mm.

21. The method according to claim 14, further comprising forming the slit opening to have a width of greater than 0.1 mm.

22. The method according to claim 14, further comprising forming the slit opening to have a width between 0.15 mm and 0.25 mm.

23. The method according to claim 14, further comprising forming the slit opening to have a width of about 0.2 mm.

24. The method according to claim 14, wherein the end opening is displaced by greater than zero millimeter from the central axis of the ion source tube toward the slit opening.

25. A PET tracer production system, the system comprising:

a target comprising atoms of a first type;

an ion source adapted to produce one or more ions from a plasma discharge; and a particle accelerator capable of accelerating the one or more ions and directing the one or more ions towards the target to change the atoms of the first type to atoms of a second type;

wherein the ion source comprises an ion source tube, the ion source tube comprising:

a slit opening along a side of the ion source tube, wherein the slit opening has a width less than 0.29 mm;

an end opening in an end of the ion source tube, wherein the end opening is smaller than an inner diameter of the ion source tube and is displaced by 0–1.5 mm from a central axis of the ion source tube toward the slit opening; and a cavity that accommodates the plasma discharge.

26. The PET tracer production system according to claim 25, wherein the atoms of the second type are isotopes of the atoms of the first type.

27. The PET tracer production system according to claim 25, wherein the particle accelerator is a cyclotron accelerator.

28. The PET tracer production system according to claim 25, wherein the end opening of the ion source tube has a diameter of 2.5–5 mm.

29. The PET tracer production system according to claim 25, wherein at least one of a built-in restrictor and the end opening causes an edge of the plasma discharge to be 0.2–0.5 mm away from the slit opening.

30. The PET tracer production system according to claim 25, wherein the plasma discharge has a diameter of 2.5–5 mm.

31. The PET tracer production system according to claim 25, wherein the slit opening of the ion source tube has a width of greater than 0.1 mm.

32. The PET tracer production system according to claim 25, wherein the slit opening of the ion source tube has a width between 0.15 mm and 0.25 mm.

33. The PET tracer production system according to claim 25, wherein the slit opening of the ion source tube has a width of about 0.2 mm.

34. The PET tracer production system according to claim 25, wherein the ion source tube has a one-piece construction.

35. The PET tracer production system according to claim 34, wherein the one-piece ion source tube further comprises a restrictor ring for insertion into the ion source tube to alter the geometry of the cavity.

36. The PET tracer production system according to claim 25, wherein the ion source tube is biased as an anode for the plasma discharge.

37. The PET tracer production system according to claim 25, wherein the end opening of the ion source tube is displaced by greater than zero millimeter from the central axis of the ion source tube toward the slit opening.

* * * * *